US006392335B1

(12) United States Patent
Arai

(10) Patent No.: US 6,392,335 B1
(45) Date of Patent: May 21, 2002

(54) ELECTRON GUN FIXER

(75) Inventor: Shinji Arai, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/568,967

(22) Filed: May 11, 2000

(30) Foreign Application Priority Data

May 12, 1999 (JP) ..... 11-130939

(51) Int. Cl.[7] ..... H01J 29/46
(52) U.S. Cl. ..... 313/451; 313/482
(58) Field of Search ..... 313/482, 414, 313/451, 240, 282

(56) References Cited

U.S. PATENT DOCUMENTS 4,374,344 A * 2/1983 Misono et al. ..... 313/479
4,885,503 A * 12/1989 Takahashi et al. ..... 313/450
5,210,460 A * 5/1993 Utsumi et al. ..... 313/456

FOREIGN PATENT DOCUMENTS

JP 6-260111 9/1994

* cited by examiner

*Primary Examiner*—Robert H Kim
*Assistant Examiner*—Jurie Yun
(74) *Attorney, Agent, or Firm*—McGinn & Gibb, PLLC

(57) ABSTRACT

An electron gun fixer comprising bulb spacers fixed to an electron gun to be inserted into a bulb neck. Each of the bulb spacers has a supporting portion to be put into press contact with the inner surface of the bulb neck. The expression "R1≧R2>R3" holds for the supporting portion, where R1 is the radius of curvature in the cross section along the direction of insertion of the electron gun into the bulb neck, R2 is the curvature of a peripheral part in the cross section perpendicular to the direction of insertion, and R3 is the radius of curvature for the remaining parts in the cross section perpendicular to the direction of insertion. R2 is substantially equal to the radius of curvature R0 of the bulb neck.

4 Claims, 5 Drawing Sheets

ELECTRON GUN FIXER

BACKGROUND OF THE INVENTION

1. Field of the Invention

The invention relates to an electron gun fixer for use in a color cathode-ray tube and the like, and more particularly to an electron gun fixer which prevents damage and the like to the conductive film on the inner surface of a bulb neck.

2. Description of the Related Art

A cathode-ray tube has an electron gun fixer. A cathode-ray tube is disclosed, for example, in Japanese Patent Application Laid-Open (JP-A) No. 6-260111. FIG. 1A is a schematic diagram showing a conventional electron gun fixer in its entirety, and FIG. 1B is an enlarged schematic diagram showing the essential parts thereof. Hereinafter, the conventional electron gun fixer shown in FIGS. 1A and 1B will be referred to as a first conventional example.

The electron gun fixer 20 according to the first conventional example has a plurality of electrodes 21 coaxially arranged in sequence. These electrodes 21 are fixed and supported by an insulating support 22 to constitute an electron gun body 23. A stem section 24 is arranged on the cathode-ray-tube-neck side of the electron gun body 23. On the extremity of the electron gun body 23 opposite the stem section 24 is provided a shield cup 25. The shield cup 25 has a plurality of bulb spacers 29 arranged at regular intervals on a concentric circle. The bulb spacers 29 have legs 27 which are fixed at one ends to the shield cup 25 via fixing portions 26. On the other ends of the legs 27 are formed supporting portions 28. Each of the supporting portions 28 is partly shaped into a spherical surface, and put into press contact with the inner surface of a bulb neck. The bulb spacers 29 are made of spring material.

In the first conventional example of such configuration, the plurality of bulb spacers 29 are balanced with each other by their spring forces while the electron gun fixer 20 is fixed in the bulb neck.

Now, description will be given of another conventional electron gun fixer. Hereinafter, this conventional electron gun fixer will be referred to as a second conventional example. FIG. 2A is a schematic diagram showing the conventional electron gun fixer (the second conventional example) in its entirety, and FIG. 2B is an enlarged schematic diagram shown the essential parts thereof.

The electron gun fixer 30 according to the second conventional example has a plurality of electrode 21 coaxially arranged in sequence. These electrodes 21 are fixed and supported by an insulating support 22 to constitute an electron gun body 23. A stem section 24 is arranged on the cathode-ray-tube-neck side of the electron gun body 23. On the extremity of the electron gun body 23 opposite the stem section 24 is provided a shield cup 25. The shield cup 25 has a plurality of bulb spacers 35 arranged at regular intervals on a concentric circle. The bulb spacers 35 have legs 32 and 33. The legs 32 are fixed at one ends to the shield cup 25 via fixing portions 31, and the legs 33 are coupled to the legs 32. The legs 33 extend in the directions at an acute angle to the extending directions of the legs 32. Accordingly, the leg portions consisting of the legs 32 and 33 have a crooked shape. on the other ends of the legs 33 are formed supporting portions 34. Each of the supporting portions 34 is partly shaped into a spherical surface, and put into press contact with the inner surface of a bulb neck. The bulb spacers 35 are made of spring material.

In the second conventional example of such configuration, the plurality of bulb spacers 35 are balanced with each other by their spring forces while the electron gun fixer 30 is fixed in the bulb neck.

FIGS. 3A through 3C are schematic diagrams showing the details of the supporting portions in the conventional electron gun fixers. FIG. 3B is a cross-sectional view along the line A—A in FIG. 3A, and FIG. 3C is a cross-sectional view along the line B—B in FIG. 3A.

As shown in FIGS. 3A–3C, the supporting portions 28, 34 of the conventional bulb spacers 29, 35 have an ellipsoidal shape. The supporting portions 28, 34 have a constant radius of curvature of e.g. R4 along the direction of insertion, and a constant radius of curvature of e.g. R5 along the direction perpendicular thereto. Here, these radii of curvature R4 and R5 are relatively small. The reason for this is to prevent the cuts on the edges of the supporting portions 28, 34 from coming into contact with the bulb neck inner surface to damage the bulb neck inner surface when the bulb spacers 29, 35 are deformed before or during the insertion.

As compared to the bulb spacers 29 in the first conventional example, the bulb spacers 35 in the second conventional example have a wider range of motion of their leg portions made of spring material. This allows a reduction in spring rigidity. Accordingly, even when the gap between the bulb neck inner surface and the electron gun fixer is small, the second conventional example is easy to insert, and therefore is in greater use recently.

In inserting the electron gun fixers into the bulb neck of a cathode-ray tube, compressive forces are applied from the bulb neck inner surface to the bulb spacers' supporting portions 28, 34 to compress the bulb spacers 29, 35, which spread out wider than the bulb neck inner surface if no force is applied thereto.

However, since the radii of curvature R4 and R5 are small as mentioned previously, the supporting portions 28, 34 and the bulb neck inner surface practically make point contact with each other as shown by a contact zone 41 in FIG. 3A. In other words, the supporting portions and the bulb neck are very small in contact area. Accordingly, the contact points on the bulb neck inner surface are subjected to excessive pressures. This produces the problem that the conductive film on the inner surface of the bulb neck is damaged and peeled off on the occasion when the electron gun fixer 20, 30 is inserted into the bulb neck. In addition, simply inserting the electron gun fixer 20, 30 along the tube axis linearly does not always provide a match between the scanning direction on the screen and the RGB alignment of the electron gun fixer 20, 30. Therefore, the insertion is sometimes followed by rotation for directional adjustment. This also produces the problem of damaging and peeling the conductive film on the inner surface of the bulb neck due to the same reason.

SUMMARY OF THE INVENTION

An object of the present invention is to provide an electron gun fixer having bulb spacers that can prevent the conductive film on the inner surface of the bulb neck from being damaged and peeled off in the steps of inserting the electron gun fixer along the tube axis linearly and rotating the same.

According to one aspect of the present invention, an electron gun fixer comprises bulb spacers fixed to an electron gun to be inserted into a bulb neck. Each of these bulb spacers has a supporting portion to be put into press contact with the inner surface of the bulb neck. The expression "$R1 \geqq R2 > R3$" holds for this support portion, where R1 is the radius of curvature in the cross section along the direction of insertion of the electron gun into the bulb neck, R2 is the radius of curvature of a peripheral part in the cross section perpendicular to the direction of insertion, and R3 is the radius of curvature of the remaining parts in the cross section perpendicular to the direction of insertion. R2 is substantially equal to the radius of curvature R0 of the bulb neck.

The supporting portion of each bulb spacer in the present invention has the spherical surface whose radius of curvature R2 in the region excepting the rims in the direction perpendicular to the direction of insertion of the electron gun fixer is almost the same as the radius of curvature of the bulb neck inner surface. Therefore, the contact portion between the bulb spacer's supporting portion and the bulb neck inner surface takes the shape of an arc, not of a point as conventional. Besides, the radius of curvature R1 of the bulb spacer's supporting portion along the direction of insertion of the electron gun fixer is equal to or greater than the radius of curvature R2 mentioned above. Therefore, the arc formed by the contact portion between the bulb spacer's support portion and the bulb neck inner surface becomes a band having a certain width, not a line having no width. As a result, the bulb spacers in the present invention become extremely small in the contact pressure with the bulb neck inner surface as compared to the cases of the point contacts made by the conventional bulb spacers. This precludes the problem of damaging and peeling the conductive film on the bulb neck inner surface even when the electron gun fixer is inserted and rotated as conventional.

The bulb spacers, due to some deformation inevitable from the handling or the like before insertion, are actually inserted and rotated as deformed to some degree. Because of the bulb spacer deformation, the cuts on the edges of the bulb spacers' supporting portions can be brought into contact with the bulb neck inner surface, possibly causing the problem of the conductive film on the bulb neck inner surface being easily damaged and peeled off. However, the supporting portions of the bulb spacers in the present invention have the radius of curvature R3 for the spherical surfaces on their rims in the direction perpendicular to the direction of insertion of the electron gun fixer, the radius of curvature R3 being smaller than the radius of curvature R2 in the non-rims. This gives an inwardly rounded shape to the cuts on the edges of the bulb spacers' supporting portions, whereby the cuts on the edges are kept from direct contact with the bulb neck inner surface even when the bulb spacers have some deformation. Therefore, while the bulb spacers' support portions in the present invention have the spherical surfaces whose radius of curvature R2 in the region excepting the rims in the direction perpendicular to the direction of insertion of the electron gun fixer is almost the same as the radius of curvature of the bulb neck inner surface, there is no possibility of the cuts on the edges of the supporting portions coming into contact with the inner surface of the bulb neck.

The nature, principle, and utility of the invention will become more apparent from the following detailed description when read in conjunction with the accompanying drawings in which like parts are designated by like reference numerals.

DETAILED DESCRIPTION OF THE PREFERRED EMBODIMENT

Figure 4A:
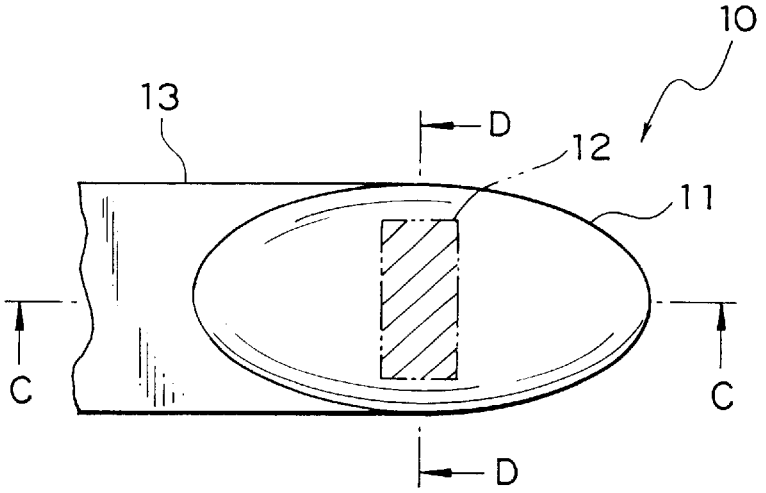
FIGS. 4A through 4C are schematic diagrams showing the details of the supporting portions in the electron gun fixer according to an embodiment of the present invention.
Figure 4B:
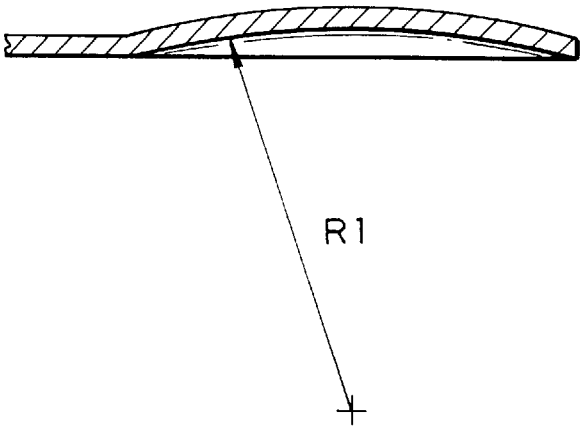
Figure 4C:
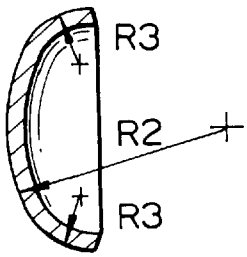

Hereinafter, the electron gun fixer according to an embodiment of the present invention will be described in the concrete with reference to the accompanying drawings. FIGS. 4A through 4C are schematic diagrams showing the details of the supporting portions in the electron gun fixer according to the embodiment of the present invention. FIG. 4B is a cross-sectional view along the line C—C in FIG. 4A, and FIG. 4C is a cross-sectional view along the line D—D in FIG. 4A.

Figure 1A:
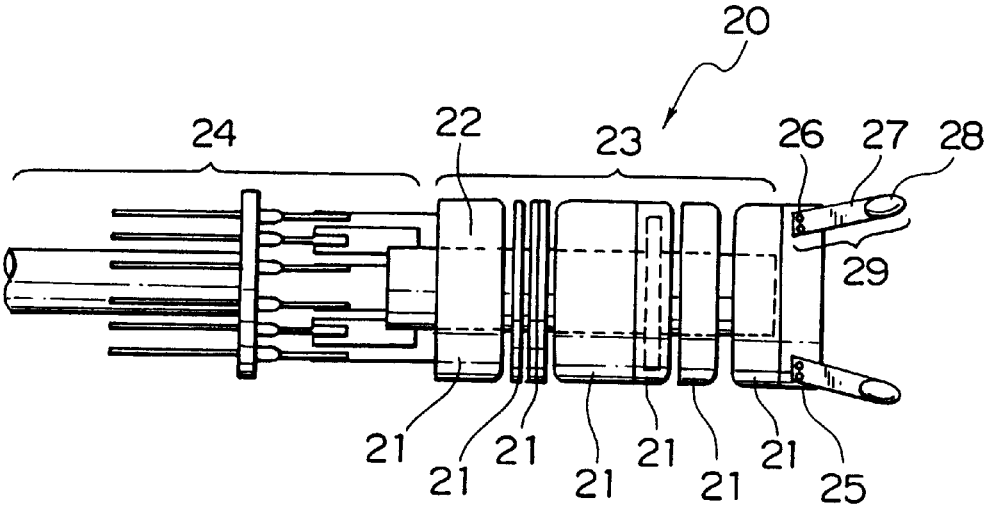
FIG. 1A (PRIOR ART)
FIG. 1A is a schematic diagram showing a conventional electron gun fixer (the first conventional example) in its entirety.
Figure 1B:
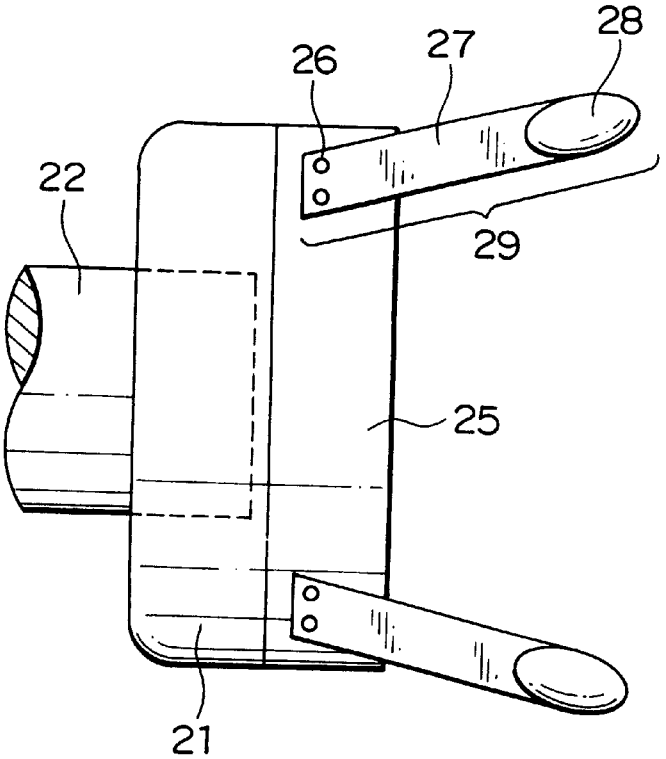
FIG. 1B (PRIOR ART)
FIG. 1B is an enlarged schematic diagram showing the essential parts thereof.
Figure 2A:
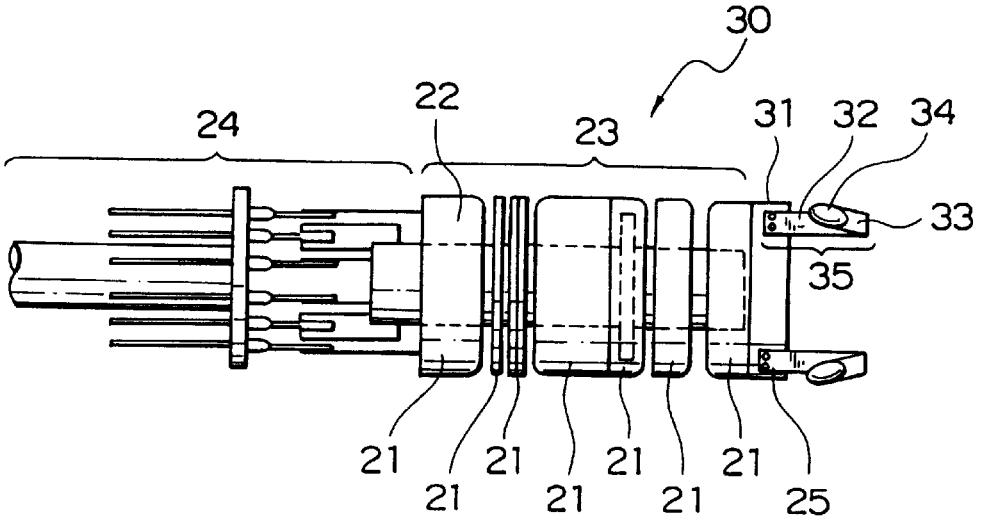
FIG. 2A (PRIOR ART)
FIG. 2A is a schematic diagram showing a conventional electron gun fixer (the second conventional example) in its entirety.
Figure 2B:
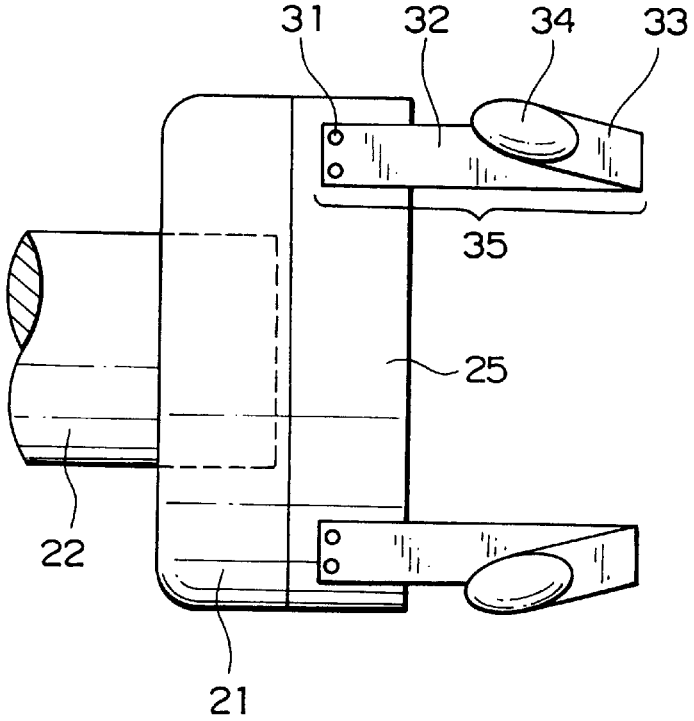
FIG. 2B (PRIOR ART)
FIG. 2B is an enlarged schematic diagram showing the essential parts thereof.

The electron gun fixer according to the present embodiment has an electron gun body, a stem section, and a shield cup. The electron gun body is composed of a plurality of electrodes and an insulating support. The electron gun body, stem section, and shield cup have the same configurations as those of the conventional electron gun fixers shown in FIGS. 1 and 2. Meanwhile, the bulb spacers are different from the conventional ones in shape.

The bulb spacers 10 in the present embodiment have leg portions 13 which are fixed at one ends to the shield cup via fixing portions (not shown). The leg portions 13 have the same shape as that of the legs 27 shown in FIG. 1B, that of the leg portions consisting of the legs 32 and 33 shown in FIG. 2, or the like. On the other ends of the leg portions 13 are formed supporting portions 11. Each of the supporting portions 11 is partly shaped into a spherical surface, and put into press contact with the bulb neck inner surface. The bulb spacers 10 are made of spring material.

As shown in FIGS. 4A through 4C, the supporting portions 11 of the bulb spacers 10 have a shape of smoothly-connected, several spherical surfaces having different radii of curvature. There holds the expression "$R1 \geqq R2 > R3$," where, as shown in FIGS. 4B and 4C, R1 is the radius of curvature in the cross section along the direction of insertion of the electron gun fixer, R3 is the radius of curvature of the rims in the cross section perpendicular to the direction of insertion of the electron gun fixer, and R2 is the radius of curvature of the remaining region. In addition, the radius of curvature R2 is substantially equal to the radius of curvature of the bulb neck inner surface with which the bulb spacers make press contact.

Figure 3A:
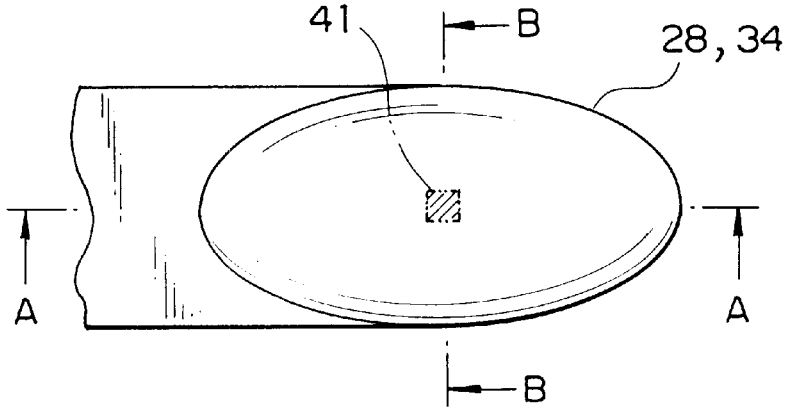
FIG. 3A (PRIOR ART)
FIGS. 3A through 3C are schematic diagrams showing the details of the supporting portions in the conventional electron gun fixers.
Figure 3B:
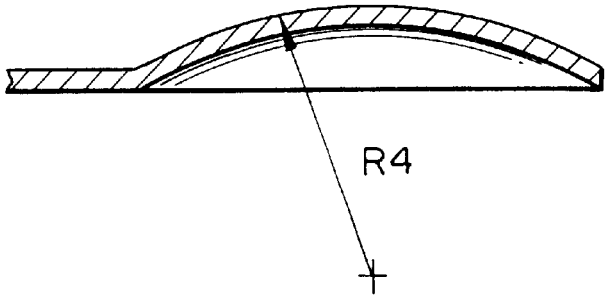
FIG. 3B (PRIOR ART)
Figure 3C:
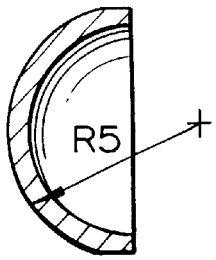
FIG. 3C (PRIOR ART)

In the present embodiment of such configuration, the supporting portions 11 and the bulb neck inner surface make surface contact with each other as shown by a contact zone 12 in FIG. 4A. This offers a contact zone approximately 10 times as wide as that in the conventional point contact (the contact zone 41 shown in FIG. 3A). As a result, the contact pressure in the present embodiment is reduced to the order of 1/10 the conventional one.

Moreover, in the cross section perpendicular to the direction of insertion of the electron gun fixer, the radius of curvature R3 of the spherical surfaces in the rims is smaller than the radius of curvature R2. This gives an inwardly rounded shape to the cuts on the edges of the supporting portions. Accordingly, even if the bulb spacers 10 are deformed to some degree, the cuts on their edges are kept from direct contact with the inner surface of the bulb neck. Therefore, while in the present embodiment the radius of curvature R2 is almost the same as the radius of curvature of the bulb neck inner surface, there is no possibility of the cuts on the edges of the supporting portions 11 coming into contact with the inner surface of the bulb neck.

Consequently, according to the present embodiment, the conductive film formed on the inner surface of the bulb neck can be prevented from being damaged and peeled off even when the electron gun fixer is inserted to and rotated in the bulb neck as conventional.

Figure 5:
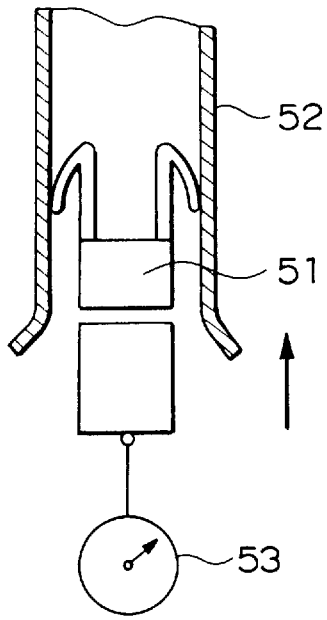
FIG. 5 is a cross-sectional view showing the method of measuring the load (pressure) in inserting an electron gun fixer into a bulb neck.
Figure 6:
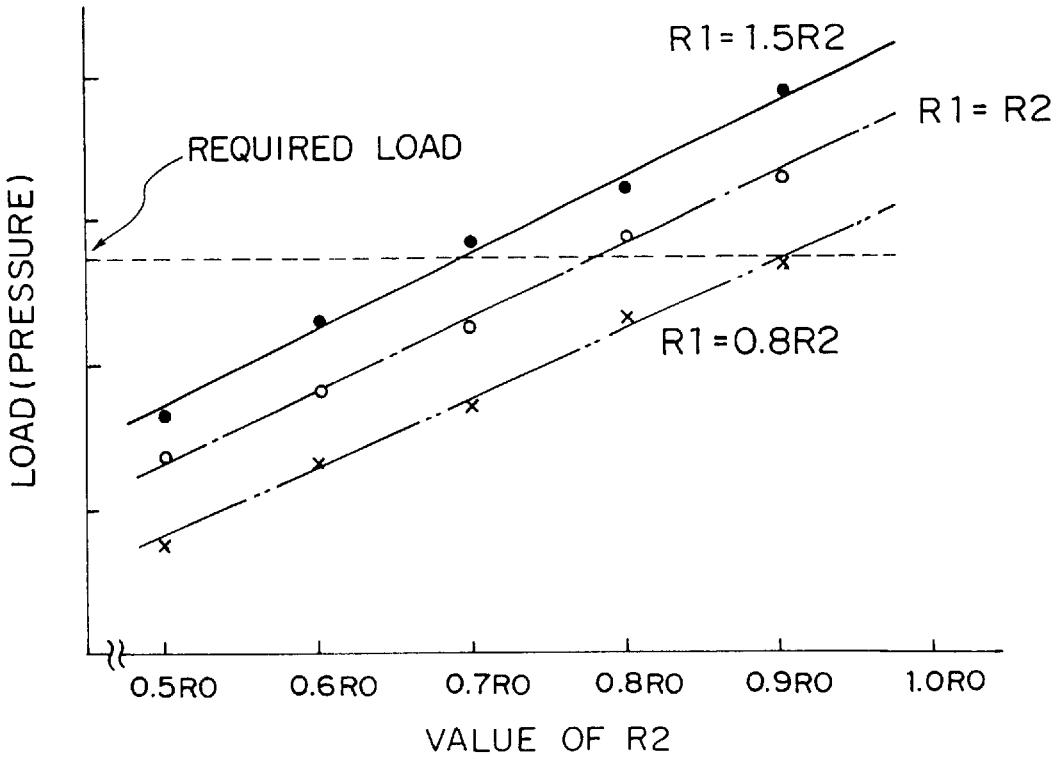
FIG. 6 is a graph showing the relationship between the radius of curvature R2 and the load (pressure) in inserting an electron gun fixer into a bulb neck.

Now, description will be given of the preferable relationship among the radii of curvature R1, R2, and R3. FIG. 5 is a cross-sectional view showing the method of measuring the load (pressure) in inserting an electron gun fixer into a bulb neck. FIG. 6 is a graph showing the relationship therebetween, on which the abscissa represents the radius of curvature R2 and the ordinate the load (pressure) in inserting an electron gun fixer into a bulb neck. The present inventor inserted electron gun fixers 51 into bulb necks 52 as shown in FIG. 5 while changing the radii of curvature R1, R2, and R3 over a wide range, and measured the loads with a load meter 53. FIG. 6 shows the measurements obtained. Incidentally, in FIG. 6, R0 represents the radius of curvature of the inner surface of the bulb neck 52.

Radii of curvature R2 above the radius of curvature R0 decrease the contact area with the bulb neck. Besides, radii of curvature R3 approaching the radius of curvature R0 raise the possibility of scratches being made on the conductive film on the inner surface of the bulb neck due to accuracy variations in mounting. Therefore, the radius of curvature R2 is preferably equal to or smaller than the radius of curvature R0. In addition, the radius of curvature R3 is preferably smaller than 0.8×R0 for the sake of securing margins. Moreover, as shown in FIG. 6, the radius of curvature R1 needs to be greater than the radius of curvature R2, and the radius of curvature R2 is preferably equal to or greater than 0.8×R0.

As has been described above, according to the present invention, the contact pressure with the bulb neck inner surface is reduced to a considerable degree as compared to the cases of the conventional electron gun fixers. As a result, the damage and peel of the conductive film on the bulb neck inner surface are avoided even when the electron gun fixer is inserted to and rotated in the bulb neck.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An electron gun fixer comprising, bulb spacers fixed to an electron gun, said electron gun being to be inserted into a bulb neck, and said bulb spacers each having a supporting portion to be put into press contact with the inner surface of said bulb neck, wherein the equation "R1≧R2>R3" holds for said supporting portion, where R1 is the radius of curvature in the cross section along the direction of insertion of said electron gun into said bulb neck, R2 is the radius of curvature of a peripheral part in the cross section perpendicular to the direction of insertion, and R3 is the radius of curvature of the remaining parts in the cross section perpendicular to the direction of insertion; and R2 is substantially equal to the radius of curvature R0 of said bulb neck.

2. The electron gun fixer according to claim 1, wherein each of said bulb spacers has a leg portion fixed to said electron gun, bent at an acute angle.

3. The electron gun fixer according to claim 1, wherein "0.8×R0≦R2<1.0×R0" and "R3<0.8×R0" hold for the radii of curvature R0, R1, R2, and R3.

4. The electron gun fixer according to claim 2, wherein "0.8×R0≦R2<1.0×R0" and "R3<0.8×R0" hold for the radii of curvature R0, R1, R2, and R3.

* * * * *